US008749170B2

(12) United States Patent
Carraro et al.

(10) Patent No.: US 8,749,170 B2
(45) Date of Patent: Jun. 10, 2014

(54) DEVICE FOR CONTROLLING POWER SUPPLY TOWARDS LIGHT SOURCES AND RELATED METHOD

(75) Inventors: Federico Carraro, Cornuda (IT); Paolo De Anna, Vallà di Riese Pio X (IT); Diego Fighera, Montebelluna (IT)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 252 days.

(21) Appl. No.: 13/085,496

(22) Filed: Apr. 13, 2011

(65) Prior Publication Data

US 2011/0260650 A1 Oct. 27, 2011

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
USPC ..... 315/306; 315/291; 315/207

(58) Field of Classification Search
USPC ..... 315/306, 119, 207; 323/220–233
See application file for complete search history.

(56) References Cited

U.S. PATENT DOCUMENTS

| | | | | |
|---|---|---|---|---|
| 8,310,169 | B2 * | 11/2012 | Yu | 315/246 |
| 2008/0224636 | A1 * | 9/2008 | Melanson | 315/307 |
| 2009/0237007 | A1 * | 9/2009 | Leng | 315/297 |
| 2010/0308739 | A1 * | 12/2010 | Shteynberg et al. | 315/193 |
| 2012/0169240 | A1 * | 7/2012 | Macfarlane | 315/152 |

FOREIGN PATENT DOCUMENTS

| | | | |
|---|---|---|---|
| DE | 3832109 | A1 | 3/1990 |
| EP | 2164300 | A1 | 3/2010 |
| WO | 2009029553 | A2 | 3/2009 |
| WO | WO 2009029553 | * | 5/2009 |

OTHER PUBLICATIONS

English abstract of DE 3832109 A1.

* cited by examiner

*Primary Examiner* — Alexander H Taningco
*Assistant Examiner* — Dylan White

(57) ABSTRACT

In various embodiments, a device for controlling power supply towards at least one light source comprising a load having a value variable as a result of switching of at least one switch coupled thereto, is provided. The device may include: a power supply set controllable to determine the intensity of the current fed towards said load; a current feedback loop sensitive to the intensity of the current fed towards said load, said current feedback loop connected to said power supply set to maintain the intensity of the current fed towards said load upon variation of said load; and a voltage control sensitive to the voltage across said load, said voltage control likewise connected to said power supply set to maintain the intensity of the current fed towards said load upon variation of said load.

5 Claims, 2 Drawing Sheets

DEVICE FOR CONTROLLING POWER SUPPLY TOWARDS LIGHT SOURCES AND RELATED METHOD

CROSS-REFERENCE TO RELATED APPLICATION

This application claims priority to Italian Patent Application Serial No. TO 2010 A 000334, which was filed Apr. 21, 2010, and is incorporated herein by reference in its entirety.

TECHNICAL FIELD

This disclosure relates to techniques for controlling power supply towards light sources. This disclosure was devised with specific attention paid to its possible application to the control of power supply towards light sources which are subjected to an output intensity regulating function (so-called "dimming") implemented via Pulse Width Modulation, PWM, by making use of the fact that the output intensity of such a light source is dependent on the (average) intensity of the current flowing through the source itself Light emitting diode (LED) light sources are an example of sources having such a feature.

BACKGROUND

The flow diagram in FIG. 1 schematically shows a light source L including, for example, one or more LEDs L1, L2, L3, . . . (connected in series, in the illustrated example), organized in one or more cells, to which a respective switch can be coupled, for example an electronic switch S1, S2. The switch is connected to the respective LED cell in such a way that, when the switch is open, the current Iout coming from a power supply source 10 flows through the LED or the LEDs of the cell, which are therefore energized, whereas when the switch is closed (i.e. conductive), current flows through the switch itself and not through the LED or the LEDs, which are therefore de-energized.

By controlling the opening and closing of the switch or switches S1, S2, for example by varying the duty cycle of a rectangular waveform driving the opening and closing of the switch or switches, and as a consequence by varying the duration of the time intervals during which the individual LED cells are either energized or short-circuited by the respective switch, and therefore de-energized, it is possible to correspondingly vary the output light intensity. The foregoing takes place according to known criteria, so as not to require a more detailed explanation herein.

In implementing dimming solutions of the kind schematically shown in FIG. 1, it is desirable to have a current source 10 with a very rapid dynamic response, so as to be able to maintain the output current Iout flowing on the LEDs as steady as possible. This is true even in the case of a rapid variation in time of the number of LEDs that are energized at every given instant.

In order to meet this requirement, the generator 10 should behave as an ideal current generator, able to maintain the same output current value Iout wholly irrespective of the variations in the load instantly constituted by LEDs L1, L2, L3, . . . and by the switches S1, S2, . . . coupled thereto.

In the state of the art there are known direct current driving solutions for light sources such as LEDs, wherein the power source is comprised of a Switching Mode Power Supply, SPMS.

Specifically, solutions are known which are based on a feedback mechanism, wherein a signal representative of the current flowing through the load is used as a driving variable of a control loop. The design of the controller used can be for example the one known as PI (proportional/integral control), or else the design known as PID (proportional/integral/derivative).

In various known solutions, the bandwidth of the current feedback loop is maintained definitely below (approx. one tenth or less) the switching frequency of the power supply source 10 (typically in the range of 20-200 kHz). The ability to perform the dimming action is attained only through a duty-cycle modulation, used for driving the LEDs.

SUMMARY

In various embodiments, a device for controlling power supply towards at least one light source comprising a load having a value variable as a result of switching of at least one switch coupled thereto, is provided. The device may include: a power supply set controllable to determine the intensity of the current fed towards said load; a current feedback loop sensitive to the intensity of the current fed towards said load, said current feedback loop connected to said power supply set to maintain the intensity of the current fed towards said load upon variation of said load; and a voltage control sensitive to the voltage across said load, said voltage control likewise connected to said power supply set to maintain the intensity of the current fed towards said load upon variation of said load.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

In the following description, numerous specific details are given to provide a thorough understanding of embodiments. The embodiments can be practiced without one or more of the specific details, or with other methods, components, materials, etc. In other instances, well-known structures, materials, or operations are not shown or described in detail to avoid obscuring aspects of the embodiments.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

In various embodiments, the inventors have observed that such previously known solutions are unable to ensure a satisfactory operation. As a matter of fact, the variation of the current output from the power supply source, used as a feedback variable, tends to follow the voltage variation, caused by the load change due to the opening and closing of the switches in charge of the dimming function, with an intrinsic delay of the feedback loop, due to the circuit features (for example the output inductor in the case of a "buck" type converter). The feedback loop has therefore a tendency to be excessively slow in performing its control function.

Various embodiments overcome the previously described drawback.

The claims are an integral part of the technical teaching of the various embodiments provided herein.

In various embodiments, the problem of maintaining a quick and effective regulation of the output current is solved not by following, but in a way by anticipating (or predicting) the possible short-term current variation, on the basis of the voltage variations observed at the output.

Figure 1:
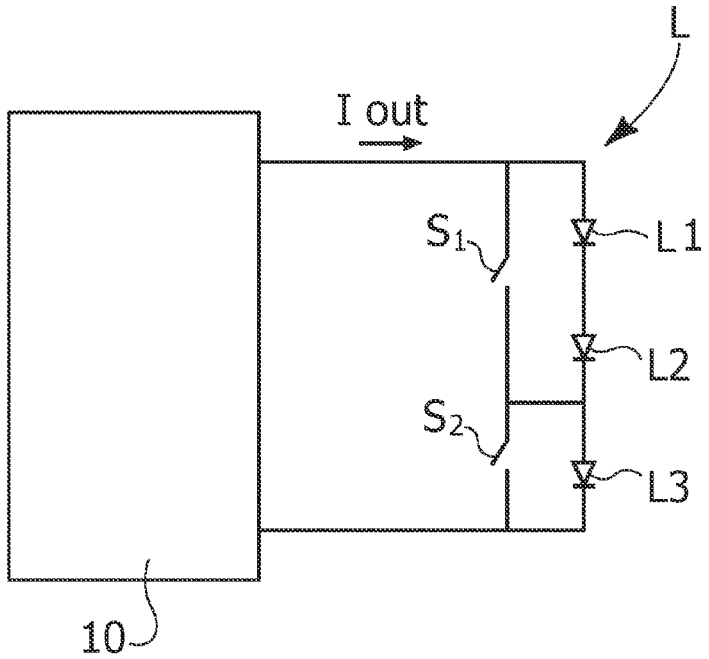
FIG. 1 has already been described in the foregoing.
Figure 2:
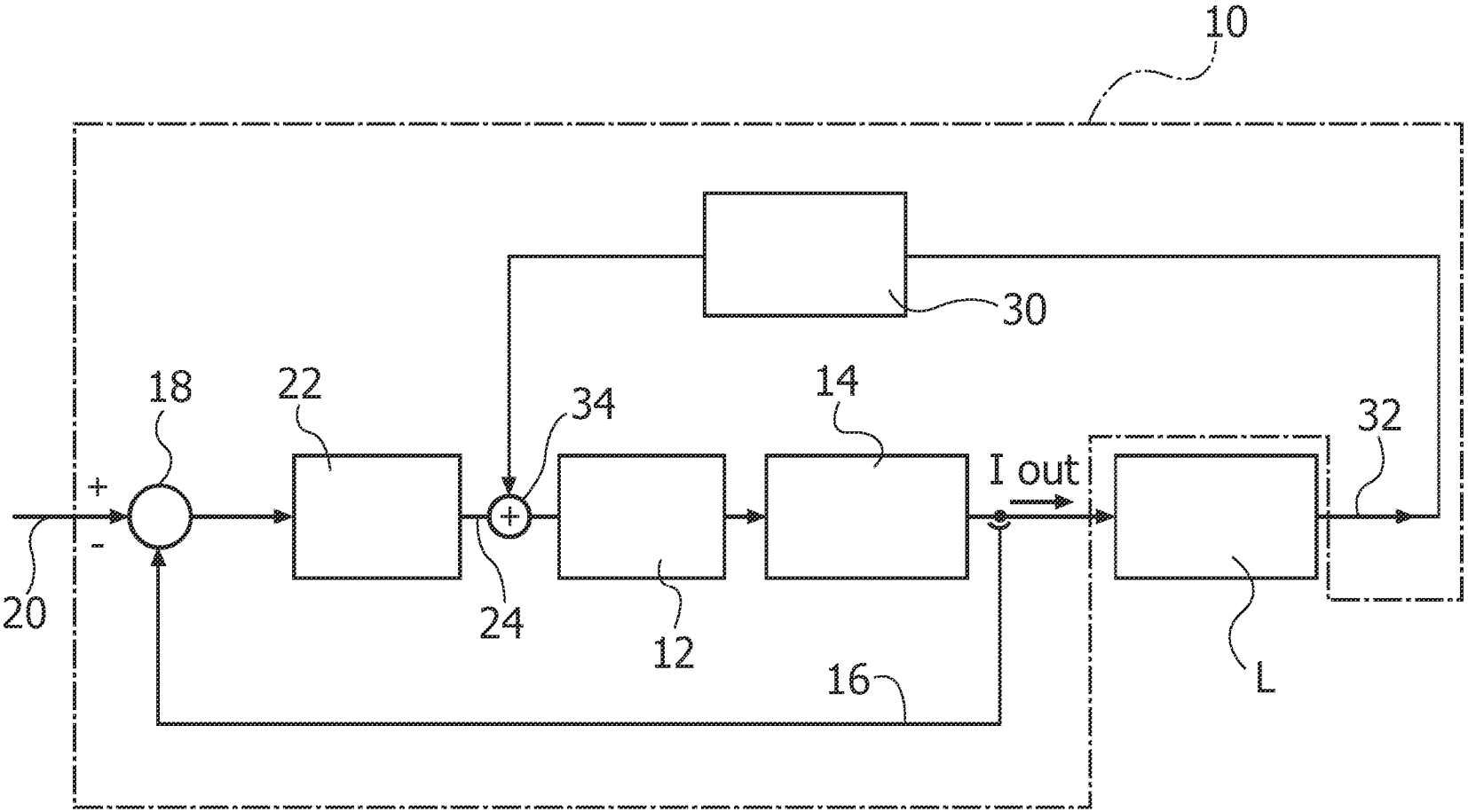
FIG. 2 shows a functional block diagram of an embodiment.

In FIG. 2, the modules enclosed by a dot-dash line are the modules adapted to be comprised in various embodiments of a power supply source 10 in a general structure of the kind shown in FIG. 1.

According to criteria known in themselves, such modules may comprise a modulator 12 driving (for example in a PWM driving mode) a power stage 14, which is adapted to supply a current Iout towards a load L consisting of one ore more LED cells with respectively associated switches S1, S2, etc., adapted to perform a dimming function according to the implementation previously described with reference to FIG. 1.

Reference 16 denotes a feedback line containing a signal indicative of the current intensity Iout. In various embodiments, line 16 converges into a summation node 18, which receives on a line 20 a reference signal representative of the desired value of the current Iout. Node 18 is a summation node with sign, which is adapted to determine the difference between the reference signal on line 20 (desired value of current Iout) and the feedback signal on line 16 (actual value of current Iout).

The signal representative of such difference is fed to the input of a module 22 of a proportional/integral (PI) type (for example $k_1+k_2/s$) or of a proportional/integral/derivative type (PID), the output line of which, denoted by 24, is adapted to act on modulator 12 driving the power stage 14 in an effort to cause the actual value of current Iout to have the same value as the desired value, set on line 20.

What has so far been described with reference to FIG. 2 substantially corresponds to criteria and operation principles known in themselves, so as not to require a detailed description herein.

Various embodiments involve the addition, to the described general design, of a further module 30, adapted to perform a so to say "predictive" function. As a matter of fact, module 30 performs on a line 32, a detection or "sensing" of the voltage present on load L, and forwards the result of the sensing operation to modulator 12, specifically to a summation node 34 interposed between module 22 and modulator 12; the output signal of module 30 therefore cooperates with the output signal of module 18 in performing the action of controlling current Iout.

Figure 3:
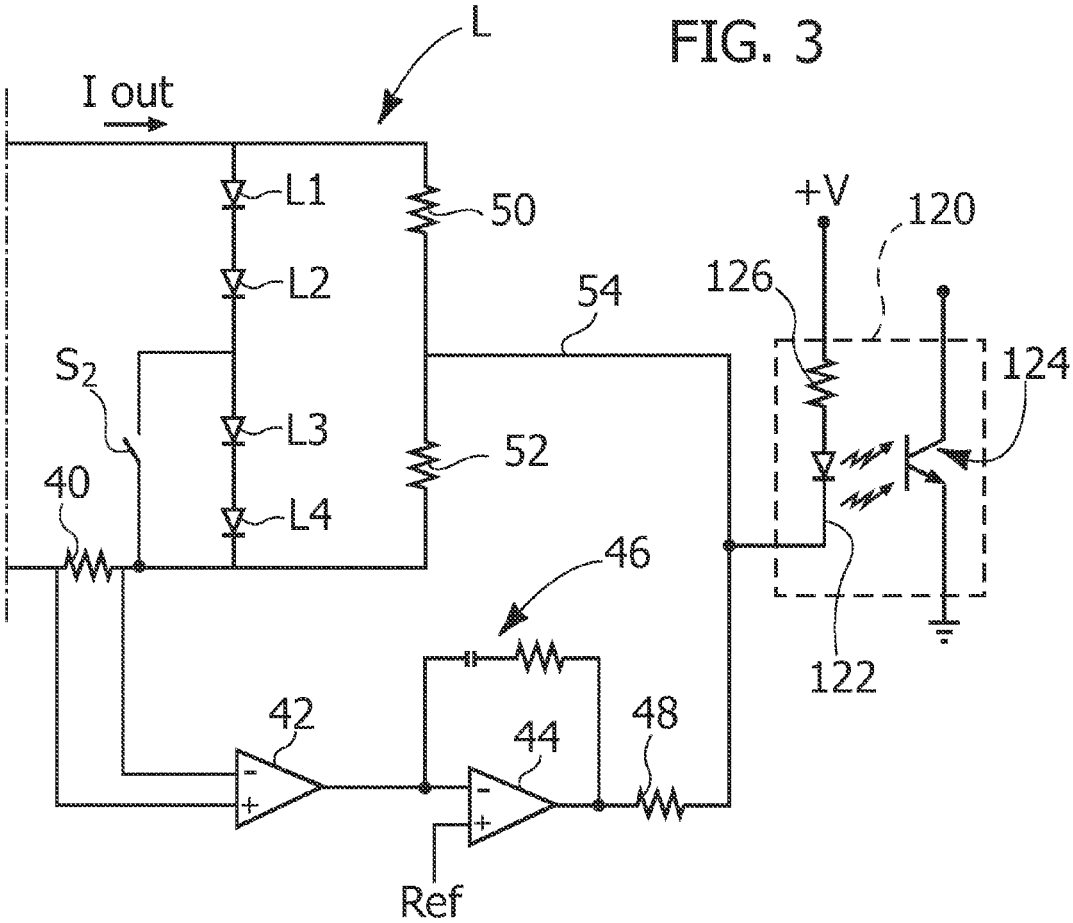
FIG. 3 shows a detail of a circuit arrangement of an embodiment.

As it will be better understood from the following detailed description of the diagram in FIG. 3, the illustration in FIG. 2 is a "high level" representation, adapted to highlight that, in various embodiments, the "current" feedback consisting in the feedback loop 16, 18, 20, 22 is complemented by an "voltage" predicting action, consisting of elements 30 and 32.

The circuit diagram in FIG. 3 shows an example of how the structure in FIG. 2 can be implemented in order to minimize the necessary components.

In the diagram of FIG. 3, references L1, L2, L3 and L4 show a plurality of light emitting diodes (LEDs) organized in several cells (for example two cells, the first including LEDs L1, L2 and the second including LEDs L3 and L4) with the presence of a single switch S2 which, when it is brought to its closing position, short-circuits LEDs L3 and L4 to perform the desired dimming function.

FIG. 3 highlights (in contrast to the diagram in FIG. 1) the fact that not all LED cells making up load L must necessarily have respective dimming switches coupled thereto.

In the case of what depicted in FIG. 3, LEDs L1 and L2 have no dimming switch coupled thereto. In contrast, LEDs L3 and L4 have a respective associated switch S2 to perform the dimming action.

It will be understood that a function of the power supply circuit 10, in an arrangement as illustrated in FIG. 3, may consist in preventing the dimming action, exerted on the LEDs L3 and L4 through the selective closing/opening of switch S2, from having a negative effect on the intensity of the current flowing through LEDs L1 and L2, and therefore from undesirably varying the brightness thereof.

The diagram in FIG. 3 refers to embodiments wherein the feedback action towards modulator 12 is implemented via an optocoupler 120, comprising a LED emitter 122 and a phototransistor 124.

It is to be assumed that the current intensity through diode 122, the anode whereof is connected to a supply voltage +V via a biasing resistor 126, determines the current intensity output from phototransistor 124, and accordingly the voltage generated by the power stage 14 controlled by modulator 12 on load L, consisting of diode cells.

In practice, such elements are adapted to perform, according to criteria which are more clearly explained in the following (and specifically via the resistive adder comprised of the elements 50, 52, 48, 126 shown in FIG. 3), the function of driving modulator 12 by the output signal of the summation module 34 in FIG. 2.

In the embodiments referred to in FIG. 3, a sensing resistor 40 is present which is coupled to load L (for example connected in series thereto) so as to be traversed by a current the intensity whereof is representative of the current intensity Iout.

Across sensing resistor 40 a tension is applied that is likewise indicative of the current intensity Iout. This voltage is applied both to the inverting and to the non-inverting input of a differential amplifier 42. The output of amplifier 42 is in turn applied to the inverting input of an error amplifier 44.

According to the well known criteria on which the implementation of a regulator PI can be based, error amplifier 44 is counter-reacted between its output and the inverting input with an RC circuit 46. The non inverting input of error amplifier 44 is connected to a reference voltage Vref.

The output of PI regulator 44 drives input 122 of optocoupler 120 via resistors 48 (and 126), transforming the voltage output of regulator 44 into current on the LED 122.

The components denoted by 40, 42, 44, 46 and 48 constitute therefore a current feedback loop, which substantially corresponds to the loop comprised of the elements 16, 18, 20 and 22 in FIG. 2.

References 50 and 52 indicate two resistors which form a voltage divider, connected across the load L, and to the tapping point whereof a line 54 is connected which leads to the input of optocoupler 120, i.e. to the cathode of LED 122. Divider 50, 52, therefore, likewise drives the input of optocoupler 120 through line 54. Divider 50, 52 and line 54 add therefore the "predictive" action performed by block 30 in FIG. 2 to the action of regulator PI performed by block 22 in FIG. 2.

In the diagram of FIG. 3, the biasing current of optocoupler 120 is therefore made reactive (in direct proportion) to the output voltage detected on load L.

As a result, any quick change of such a load (due to the opening/closing of a switch such as switch S2) can influence without delay the modulation on the primary side of modulator 12, which is enabled to immediately adapt to the new load, without having to wait for the contribution of the current feedback loop comprising elements 40, 42, 44, 48.

The feedback action ("prediction") performed via the voltage divider 50, 52 and line 54 (block 30 in FIG. 2) can respond in very short times (within 5-20 microseconds) to any load change. At the same time, the current loop control (components 40, 42, 44, 46 and 48) keeps on performing, more slowly, its action of maintaining the current steady state.

In various embodiments, optocoupler 120 therefore may include:

an input electro-optical transducer 122, jointly acted upon by the current feedback loop 40, 42, 44, 46, 48 and the "predictive" control 50, 52, 54, and an output opto-electrical transducer 124, which drives the power supply set 12, 14.

The output of optocoupler 120 (as well as the output of the adder block 34 in FIG. 2) corresponds therefore to the overlaying of two components. The first component is given by the output of the current controller 40, 42, 44, 46 (of the PI type, in the presently considered example) which operates as a normal closed-loop current regulator. The second component is given by the output of voltage divider 50 and 52, and is therefore adapted to mirror the output voltage directly.

Various embodiments allow therefore to achieve, within a power supply circuit 10 as presently considered, a "quasi-ideal" behaviour of the current generator, with the following effects:

a very rapid control of the output current, obtained through a "predictive" behaviour, in comparison with the slower action of closed-loop current control, the ability to reduce the bandwidth of the closed-loop current control, avoiding possible unsteadiness, and a substantially unexpensive nature of the solution, enabling the omission of costly devices (e.g. DSPs) for building estimating or adaptive control devices.

It will be appreciated that the embodiment in FIG. 3 enables the overlay (sum) of the two control components, through the simple, "hard-wired" connection of two electrical lines (the one connected to resistor 48 and line 54, coming from the middle point of voltage divider 50, 52) without having to resort to complex circuit arrangements.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A device for controlling power supply towards at least one light source comprising a load having a value variable as a result of switching of at least one switch coupled thereto, the device comprising: a power supply set controllable to determine the intensity of the current fed towards said load; a current feedback loop sensitive to the intensity of the current fed towards said load, said current feedback loop connected to said power supply set to maintain the intensity of the current fed towards said load upon variation of said load; and a voltage control sensitive to the voltage across said load, said voltage control likewise connected to said power supply set to maintain the intensity of the current fed towards said load upon variation of said load, wherein said current feedback loop and said voltage control have respective output lines coupled to a summation node.

2. The device of claim 1, wherein said voltage control comprises: a voltage divider coupled to said load to sense the voltage across the load; and an output line from said voltage divider to drive said power supply set.

3. The device of claim 1, wherein said current feedback loop and said voltage control have respective output lines connected to each other.

4. The device of claim 1, further comprising: an optocoupler with an electro-optical input transducer acted upon jointly by said current feedback loop and said voltage control and an opto-electrical output transducer to drive said power supply set.

5. A method of controlling power supply towards at least one light source comprising a load having a value variable as a result of switching of at least one switch whose value varies as a result of switching of at least one switch coupled thereto, the method comprising: controlling the intensity of the current fed towards said load to maintain the intensity of the current fed towards said load upon variation of said load, wherein said controlling comprises: controlling the intensity of the current fed towards the load with a current feedback loop sensitive to the intensity of the current fed towards said load; and controlling the intensity of the current fed towards the load also with a voltage control sensitive to the voltage across said load, wherein said current feedback loop and said voltage control have respective output lines coupled to a summation node.

* * * * *